United States Patent [19]

Takman

[11] Patent Number: 4,828,170

[45] Date of Patent: May 9, 1989

[54] HEATING APPARATUS FOR HEATING CONFINED SPACES, PARTICULARLY APPARATUS FOR HEATING THE PASSENGER COMPARTMENTS OF AN AUTOMOTIVE VEHICLE AND THE LIKE

[75] Inventor: Olle Takman, Gothenburg, Sweden

[73] Assignee: AB Volvo, Gothenburg, Sweden

[21] Appl. No.: 48,666

[22] Filed: May 11, 1987

[30] Foreign Application Priority Data

May 14, 1986 [SE] Sweden ..... 8602192

[51] Int. Cl.[4] ..... B60H 1/02

[52] U.S. Cl. ..... 237/12.3 C; 237/50; 126/110 C

[58] Field of Search ..... 237/12.3 C, 12.3 B, 237/12.3 R; 431/328, 7; 126/110 C

[56] References Cited

U.S. PATENT DOCUMENTS 4,375,949 3/1983 Salooja ..... 431/328

4,501,127 2/1985 Sommers et al. ..... 431/328

FOREIGN PATENT DOCUMENTS 146880 3/1979 Norway .

*Primary Examiner*—Henry A. Bennet

*Attorney, Agent, or Firm*—Young & Thompson

[57] ABSTRACT

The invention relates to heating apparatus for heating confined spaces, and particularly for heating passenger compartments in automotive vehicles and the like. The heating apparatus comprises a combustion device having means for supplying and mixing fuel and combustion air, and an outlet for combustion gases, and further comprises a heat exchanger which is connected to the outlet of the combustion device and which is intended for heat exchange between the combustion gases and a heating medium delivered to the space to be heated. According to the invention the combustion device incorporates a catalytic reactor for catalytic combustion of at least part of the fuel-air mixture, and a thermal reactor which is located between the catalytic reactor and the combustion gas outlet and which is intended for final combustion of the fuel-air mixture at least partially combusted in the catalytic reactor.

4 Claims, 1 Drawing Sheet

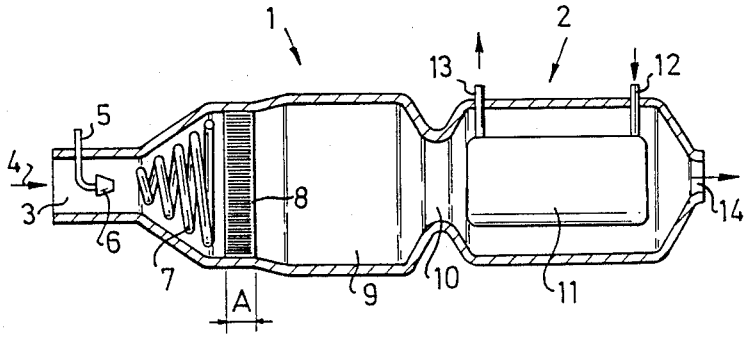
1
2
13
12
5
4
3
6
7
8
9
10
11
14
A

HEATING APPARATUS FOR HEATING CONFINED SPACES, PARTICULARLY APPARATUS FOR HEATING THE PASSENGER COMPARTMENTS OF AN AUTOMOTIVE VEHICLE AND THE LIKE

The present invention relates to heating apparatus for heating confined spaces and particularly, although not exclusively, to a heater intended for heating the passenger compartments of automotive vehicles and the like and comprising a combustion device having means for supplying and mixing fuel and combustion air and an outlet for exhaust combustion gases, and further comprising a heat exchanger which is connected to the outlet of the combustion device and which is operative to effect transfer of heat between the combustion gases and a heating medium supplied to the space to be heated.

Heaters of this kind are used to a large extent as so-called parking heaters in various types of automotive vehicles. The combustion device incorporated in such heaters normally comprises a combustion chamber into which fuel and air are injected and subsequently combusted, the ensuing hot gases of combustion transferring their thermal energy to a heating medium, this transfer being effected with the aid of a heat exchanger arranged either within the combustion chamber or adjacent thereto.

Prior art heaters of this kind are encumbered with a number of drawbacks. For example, it is extremely difficult to regulate the power output of the burner, since satisfactory combustion efficiency can be achieved solely when the variations in power are very slight. This means that a heater with which the power requirements are lower than the capacity of the heater must be switched off and restarted at given intervals. Furthermore, known heaters of this kind cannot be relied upon satisfactorily in operation, and neither is the level of efficiency of such heaters as high as would be desired.

The object of the present invention is to provide a heater of the aforesaid kind which is more reliable and more efficient than the prior art heaters, and to achieve this objective without needing to enlarge the dimensions of the heater beyond the dimensions of the prior art heaters of this kind. This object is achieved in accordance with the invention with a heater having the characteristic features set forth in the improvement clause of claim 1.

Suitable embodiments of the inventive heater are set forth in the depending claims.

The invention will now be described in more detail with reference to the accompanying drawing, the single FIGURE of which is a schematic cross-sectional view of a heater constructed in accordance with one embodiment of the invention.

The illustrated heater comprises two main parts, namely a combustion device, shown generally at 1, and a heat exchanger connected to the combustion device and shown generally at 2. The combustion device 1 incorporates, in a known manner, an air inlet 3 through which combustion air is delivered in the direction of the arrow 4, from a fan or corresponding device not shown. A fuel delivery pipe 5 opens into the air inlet 3. The fuel delivery pipe 5 is provided at the end thereof located adjacent the inlet 3 with a nozzle 6 for atomizing the fuel delivered to the combustion device and mixing said fuel with the combustion air.

The combustion device presents downstream of the air inlet 3 and the nozzle 6 a section of increasing cross-sectional area, in which heating means in the form of a heating coil 7 is arranged. The heating coil 7 of the illustrated embodiment is heated electrically, and when the heater is started-up heats the fuel-air mixture so as to vaporize all fuel present in the mixture and enable combustion to take place.

Subsequent to passing the heating coil 7, the fuel-air mixture, with the fuel in vapor form, passes into a catalytic reactor 8. The catalytic reactor 8 includes a large number of ducts or channels, through which the fuel-air mixture flows and which are delimited by walls of a carrier material coated with a catalyst material selected for achieving catalytic combustion of the prevailing fuel-air mixture. The catalytic reactor 8 extends across the whole cross-section of the combustion device 1 and the channels present an extremely wide surface area for contact with the fuel-air mixture. The length A of the catalytic reactor is selected, however, so that the fuel-air mixture is not fully combusted in the catalytic reactor 8, at least when the heater is running at full power, i.e. when the flow of fuel-air mixture is at a maximum. Thus, since the fuel-air mixture is not fully combusted in the catalytic reactor, the gases leaving the reactor will contain a relatively large proportion of combustible products.

Final combustion of the combustible products present in the gas leaving the catalytic reactor 8 occurs in a thermal reactor 9, which is arranged downstream of the catalytic reactor 8 as seen in the flow direction of the gases. The thermal reactor 9 has a size which is adapted so that substantially complete combustion can be achieved prior to the combustion gases exiting through an outlet 10 provided in the thermal reactor 9.

The heat exchanger 3 is connected to the outlet 10 on the thermal reactor 9, and is intended to effect an exchange of heat between the hot combustion gases exiting through the outlet 10 and a heating medium delivered to the space to be heated. The heat exchanger 2 is illustrated solely schematically in the drawing, the combustion gases, subsequent to leaving the thermal reactor 9 through the outlet 10, flowing around a hollow heat-exchanger body 11. A heating medium flows within the heat-exchanger body 11, from an inlet 12 to an outlet 13, while taking-up heat from the hot combustion gases. Subsequent to passing through the heat-exchanger body 11, the combustion gases leave the heat exchanger 2 through an outlet 14. The outlet 14 is, of course, connected to an exhaust pipe, although this has not been shown in the drawing.

The method of operation of the heater according to the invention will be apparent from the above description, although it can be mentioned in summary that the combustion air entering through the air inlet 3, subsequent to being mixed with fuel entering from the nozzle 6 and, when necessary, pre-heating and vaporizing the fuel in the mixture by means of the heating coil 7, flows into the catalytic reactor 8, where incomplete catalytic combustion of the fuel-air mixture takes place, this combustion being incomplete at least when the heater is running at full power. The incompletely combusted fuel-air mixture is totally combusted subsequent to passage of the mixture through the catalytic reactor 8 and into the thermal reactor 9, whereafter the hot gases of combustion exit through the outlet 10 and flow from the combustion device 1 into the heat exchanger 2, where heat from the hot gases is transferred to the heating medium, whereafter the combustion gases leave the heater through the outlet 14.

At least when starting-up the heater it is necessary to vaporize all fuel with the aid of the heating coil 7, and consequently the air flows and fuel flows are set to a relatively low level, for instance 1/5 of the flows at full power. This will result in substantially complete combustion in the catalytic reactor 8, subsequent to heating the surfaces of the catalyst to the requisite temperature, about 200°-300° C. When the temperature in the thermal reactor 9 has increased to the requisite value, e.g. 500° C., the level of air and fuel flows can be increased to their maximum values, combustion in the catalytic reactor 8 remaining incomplete. In this regard, it is still necessary to vaporize all fuel present, which can be effected by re-cycling heat from the thermal reactor 9. This is not shown on the drawing, however.

The heater according to the invention affords a number of advantages. For example, in addition to the inventive heater being more reliable than prior art heaters of this kind, it affords the advantage in comparison with purely catalytic combustion of enabling a smaller excess of air to be used while still maintaining the catalytic reactor 8 at a temperature sufficiently low to avoid damage to the catalyst material. The continued combustion in the thermal reactor 9 takes place in gas phase, and consequently a higher level of efficiency is achieved at lower air surpluses, which enables a larger fuel flow to be combusted and therewith greater power to be generated at a given cross-sectional area of the catalytic reactor 8. Furthermore, the volume of the catalytic reactor 8 is smaller than that of a heater for purely catalytic combustion, and hence less power is consumed at the start.

It will be understood that the invention is not restricted to the aforedescribed embodiment, and that modifications can be made within the scope of the following claims.

I claim:

1. In an apparatus for heating confined spaces, and particularly for heating the passenger compartments of an automotive vehicle or the like, said heating apparatus comprising a combustion device having means for supplying and mixing fuel and combustion air to form a fuel-air mixture, and a combustion gas outlet, and further comprising a heat exchanger connected to the outlet of the combustion device for heat exchange between the combustion gases and a heating medium delivered to a space to be heated, the improvement in which said combustion device includes catalytic combustion means adapted to incompletely combust the fuel-air mixture, wherein the cross-sectional area of the catalytic combustion means essentially covers the whole of the flow cross-section in the combustion device and has a length which is so adapted to said cross-sectional area as to provide a catalyst surface area which, at least when the heating apparatus is running at full power, will only permit incomplete combustion of the fuel-air mixture in the catalytic combustion means, and a thermal reactor located between the catalytic combustion means and the combustion gas outlet devoid of secondary air feed means, said thermal reactor being adapted to combust totally the fuel-air mixture incompletely combusted by the catalytic combustion means.

2. Heating apparatus according to claim 1, further comprising a pre-heating device arranged in the combustion device between the supply and mixing means for fuel and combustion air and the catalytic combustion means.

3. Heating apparatus according to claim 1, wherein said thermal reactor is devoid of separate ignition means.

4. Heating apparatus according to claim 1, wherein said combustion device is devoid of combustion means upstream of said catalytic combustion means.

* * * * *